US008881566B2

(12) United States Patent
Zuraski et al.

(10) Patent No.: US 8,881,566 B2
(45) Date of Patent: Nov. 11, 2014

(54) DISC ALIGNMENT MECHANISM

(71) Applicant: Schlage Lock Company LLC, Indianapolis, IN (US)

(72) Inventors: Robert David Zuraski, Taunton, MA (US); Mary Teresa Sarich, Boston, MA (US); Daniel Hugh Kindstrand, Plainville, MA (US); David Bruce Miller, Braintree, MA (US)

(73) Assignee: Schlage Lock Company LLC, Indianapolis, IN (US)

( * ) Notice: Subject to any disclaimer, the term of this patent is extended or adjusted under 35 U.S.C. 154(b) by 0 days.

(21) Appl. No.: 13/963,894

(22) Filed: Aug. 9, 2013

(65) Prior Publication Data

US 2014/0041426 A1 Feb. 13, 2014

Related U.S. Application Data

(60) Provisional application No. 61/681,546, filed on Aug. 9, 2012.

(51) Int. Cl.
*E05B 27/00* (2006.01)
*E05B 21/06* (2006.01)

(52) U.S. Cl.
CPC ..... *E05B 21/066* (2013.01); *E05B 21/06* (2013.01)
USPC ..... 70/366; 70/356

(58) Field of Classification Search
USPC ..... 70/365, 366, 492
See application file for complete search history.

(56) References Cited

U.S. PATENT DOCUMENTS

| | | | | | |
|---|---|---|---|---|---|
| 293,885 | A * | 2/1884 | Jackson | 70/366 |
| 1,226,257 | A * | 5/1917 | Ritzert | 70/366 |
| 1,376,256 | A * | 4/1921 | Conte | 70/366 |
| 2,524,339 | A * | 10/1950 | Young et al. | 70/366 |
| 2,578,211 | A * | 12/1951 | Spain | 70/366 |
| 2,729,091 | A * | 1/1956 | Taylor | 70/358 |
| 3,548,620 | A * | 12/1970 | Genakis | 70/493 |
| 3,928,992 | A | 12/1975 | Talbot | |
| 4,267,717 | A * | 5/1981 | Martikainen | 70/366 |
| 4,351,172 | A * | 9/1982 | Martikainen | 70/366 |
| 4,370,875 | A | 2/1983 | Piiroinen | |
| 4,407,147 | A * | 10/1983 | Larson | 70/365 |
| 5,279,138 | A * | 1/1994 | Gallagher | 70/366 |
| 5,490,405 | A | 2/1996 | Ramo et al. | |
| 6,591,645 | B1 * | 7/2003 | Wittwer | 70/366 |

(Continued)

FOREIGN PATENT DOCUMENTS

| | | |
|---|---|---|
| CN | 2138172 Y | 7/1993 |
| EP | 0212468 | 8/1986 |
| EP | 2085542 | 1/2009 |
| EP | 2360333 | 2/2011 |

OTHER PUBLICATIONS

International Search Report and Written Opinion corresponding to PCT Application (i.e. PCT/US2013/054412), mailed Jan. 29, 2014 (9 pages).
Machine translation for CN2138172Y.

*Primary Examiner* — Suzanne Barrett
(74) *Attorney, Agent, or Firm* — Krieg DeVault LLP

(57) ABSTRACT

A lock assembly is provided with a plurality of discs, one or more driver discs and a pivoting component that interacts with the discs and driver discs, providing anti-pick features.

12 Claims, 2 Drawing Sheets

(56) References Cited

U.S. PATENT DOCUMENTS

| | | | | |
|---|---|---|---|---|
| 6,725,696 | B1 * | 4/2004 | Blight et al. | 70/366 |
| 6,799,447 | B2 * | 10/2004 | Mielonen et al. | 70/366 |
| 6,854,305 | B2 * | 2/2005 | Hurskainen et al. | 70/278.3 |
| 6,880,376 | B1 * | 4/2005 | Ko | 70/366 |
| 7,665,333 | B2 | 2/2010 | Shabtay et al. | |
| 7,703,311 | B2 * | 4/2010 | Agbay | 70/366 |
| 8,074,480 | B2 | 12/2011 | Huang | |
| 8,091,393 | B2 | 1/2012 | Damikolas et al. | |
| 8,117,876 | B2 | 2/2012 | Mathachan | |
| 8,347,678 | B2 | 1/2013 | Chong | |
| 8,424,349 | B2 | 4/2013 | Marcelle et al. | |
| 2006/0016230 | A1 * | 1/2006 | Loughlin et al. | 70/366 |
| 2006/0048554 | A1 | 3/2006 | Keller | |
| 2008/0022734 | A1 | 1/2008 | McDaid et al. | |
| 2011/0265526 | A1 | 11/2011 | Zuraski | |
| 2013/0067972 | A1 | 3/2013 | Buhl | |

* cited by examiner

DISC ALIGNMENT MECHANISM

CROSS-REFERENCE TO RELATED APPLICATIONS

The present application claims the benefit of U.S. Provisional Patent Application 61/681,546 filed Aug. 9, 2012, the contents of which are incorporated herein by reference in their entirety.

BACKGROUND

The disclosed invention pertains generally to locks, and more particularly, but not exclusively, to disc tumbler locks.

SUMMARY

A lock assembly is provided with a plurality of discs, one or more driver discs and a pivoting component that interacts with the discs and driver discs, providing anti-pick features.

BRIEF DESCRIPTION OF THE ILLUSTRATIONS

DETAILED DESCRIPTION

Figure 1:
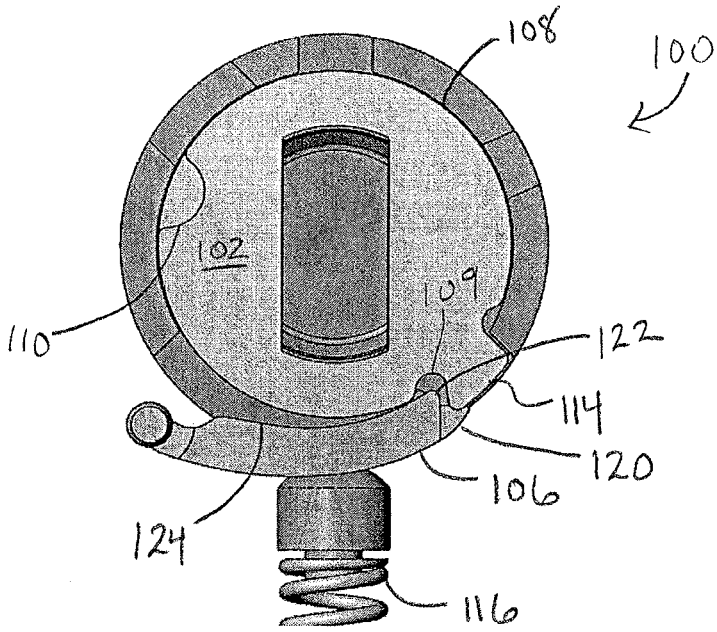
FIG. 1 illustrates an end view of a lock assembly in a locked position.
Figure 2:
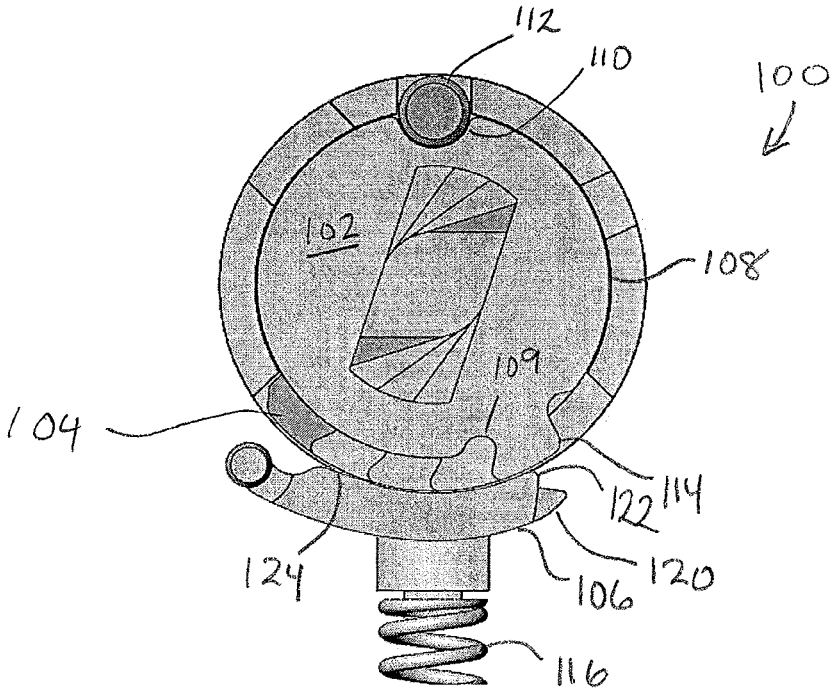
FIG. 2 depicts an end view of the lock assembly of FIG. 1 in an unlocked position.
Figure 3:
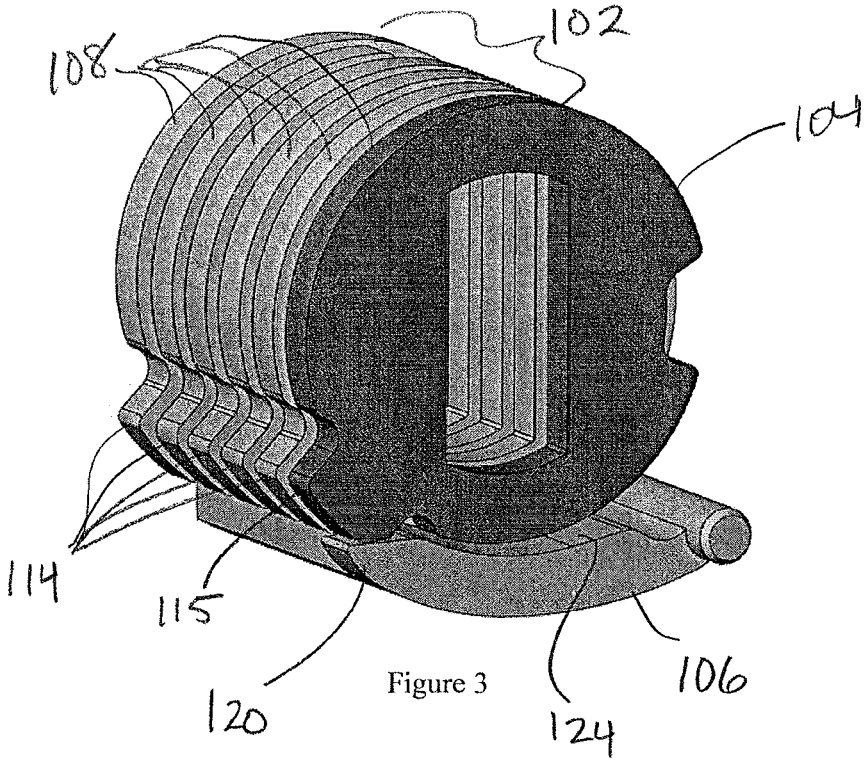
FIG. 3 shows a perspective view of the lock assembly of FIG. 1 in a locked position.

Referring now to the Figures, a lock assembly 100 is provided with a plurality of discs 102, at least one driver disc 104, and at least one pivoting component 106. The discs 102 and driver disc 104 are generally cylindrical in shape having a first generally planar surface, a second generally planar surface, and a generally circular circumferential surface 108 therebetween. The discs are further provided with a recess 110 on the circumferential surface 108 for housing a locking bar 112, and a radial extension component 114 extending radially from the circumferential surface 108. A radiused transition surface is provided between the circumferential surface 108 and the radial extension component 114 on the discs 102, such that the extension component 114 has a first width at its radially distal extent (that is to say, farther from the disc center), and a smaller second width at its radially proximal extent (that is to say, closest to the disc center where the extension component 114 meets the circumferential surface 108). As shown in FIGS. 1 and 2, the extension component 114 somewhat forms a hook 109 between the radially distal extent of the radial extension component 114 and the circumferential surface 108. In contrast, the driver disc 104 is provided with a radial extension component 115 that is of a generally uniform width, and is lacking a hook feature 109.

The pivoting component 106 is biased against all of the discs 102 and the driver disc 104 by spring 116. The pivoting component 106 is pivotally secured by a disc housing (not shown). Distal of the pivot point 118, the pivoting component 106 is provided with a pivot extension 120 that aligns with the driver disc 104. Adjacent the pivot extension 120, a generally linear edge 122 is provided along the length of the pivoting component 106. The pivoting component 106 is further provided with an arced surface 124 that substantially mimics the radius on the circumferential surface 108 of the discs 102, and the driver disc 104.

The pivoting component 106 prevents the discs 102 and the driver disc 104 from rotating until a key (not shown) is fully inserted into the lock assembly 100. At least one driver disc 104 (only one shown) is provided in the lock assembly 100 that is provided with geometry on the radial extension component 115 that interacts with the pivot extension 120 so that it can push the pivoting component 106 out of the way to release the other discs 102. The other discs 102 cannot rotate while the pivoting component 106 is fully engaged with the discs 102 such that the generally linear edge 122 is engaged with the hooks 109 of each disc 102, thus obstructing the rotational path of each disc 102. Once the key is fully inserted, the driver disc 104 is rotated first and the pivoting component 106 pivots, releasing the linear edge 122 from the disc hooks 109, allowing the key to then turn the discs 102 as needed to unlock the lock assembly 100. Once the pivoting component linear edge 122 is released from the hooks 109, the arced surface 124 on the pivoting component 106 maintains contact (via the bias provided by spring 116) with the circumferential surface 108 of the discs 102 and driver disc 104. This contact provides anti-pick benefits by applying tension to the discs 102, 104 while they rotate, which makes it difficult for a lock picker to feel the position of the discs 102, and the driver disc 104.

The foregoing written description of structures and methods has been presented for purposes of illustration. Examples are used to disclose the invention, including the best mode, and also to enable any person skilled in the art to practice the invention, including making and using any devices or systems and performing any incorporated methods. These examples are not intended to be exhaustive or to limit the invention to the precise steps and/or forms disclosed, and many modifications and variations are possible in light of the above teaching. Features described herein may be combined in any combination. Steps of a method described herein may be performed in any sequence that is physically possible. The patentable scope of the invention is defined by the appended claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. An apparatus comprising:

a first disc and a second disc aligned with the first disc, a pivoting component configured to rotate about a pivot point, and a biasing member configured to urge the pivoting component toward the first and second discs;

the first and second discs each comprising a generally circular circumferential surface and a recess configured to receive a locking bar;

the first disc further including a first radial extension component forming a hook between a radially distant extent of the first radial extension component and the circumferential surface of the first disc;

the second disc including a second radial extension component of a generally uniform width;

the pivoting component including an arced surface that substantially mimics the radius of the circumferential surfaces of the first and second discs, a generally linear edge aligned with the first disc, and an extension aligned with the second disc;

wherein the pivoting component is configured to prevent rotation of the first disc when the linear edge is engaged with the hook, and the second radial extension component is configured to interact with the extension to release the linear edge from the hook upon rotation of the second disc.

2. The apparatus of claim 1, wherein the biasing member is configured to urge the arced surface into contact with the first disc and the second disc when the linear edge is not engaged with the hook.

3. The apparatus of claim 2, further comprising a plurality of the first discs aligned with the second disc.

4. The apparatus of claim 1, wherein the second disc is adjacent to only one of the plurality of first discs.

5. The apparatus of claim 1, wherein the second radial extension component is of a generally uniform width.

6. A lock assembly comprising:

a plurality of discs;

one or more driver discs;

one or more pivoting components;

each of the plurality of discs comprises a first radial extension and a first circumferential surface with a hook formed therebetween;

each of the one or more driver discs comprises a second radial extension and a second circumferential surface;

each of the one or more pivoting components comprises a radial surface, an adjacent linear edge, and an adjacent pivot extension;

wherein the linear edge is configured to engage the hook in a first position of the one or more pivoting components, the pivot extension is configured to interact with the second radial extension, and the radial surface is configured to interact with the first and second circumferential surfaces;

wherein engagement between the hook and the one or more pivoting components is configured to prevent rotation of the plurality of discs;

wherein interaction of the pivot extension and the second radial extension is configured to pivot the one or more pivoting components to a second position in response to rotation of the one or more driver discs; and wherein in the second position of the one or more pivoting components, the linear edge is disengaged from the hook.

7. A lock assembly according to claim 6, wherein the linear edge is configured to prevent rotation of the discs when the pivoting component is fully engaged with the discs.

8. A lock assembly according to claim 7, wherein the second radial extension is configured to rotate the pivoting component upon rotation of the driver disc, thereby releasing the linear edge from the hooks.

9. A lock assembly according to claim 8, further comprising a biasing member configured to urge the pivoting component into contact with the discs and the driver disc.

10. A lock assembly according to claim 9, wherein the pivoting component is configured to apply tension to the discs in response to rotation of the discs.

11. A method of operating a disc tumbler lock assembly including a plurality of discs, a driver disc, and a pivoting component configured to selectively prevent the discs and the driver disc from rotating, the method comprising:

inserting a key into the disc tumbler lock assembly;

rotating the driver disc, thereby rotating the pivoting component from a first position in which it prevents rotation of the discs to a second position in which it does not prevent rotation of the discs; and rotating the key, thereby turning the discs and unlocking the disc tumbler lock assembly.

12. A method according to claim 11, further comprising:

urging an arced surface of the pivoting component into contact with a circumferential surface of the discs and the driver disc, thereby applying tension to the discs and the driver disc as they rotate.

* * * * *